US005511478A

United States Patent [19]

Lindner et al.

[11] Patent Number: 5,511,478

[45] Date of Patent: Apr. 30, 1996

[54] APPARATUS FOR THE AUTOMATED CHANGING OF PRINTING PLATES OF A PRINTING MACHINE

[75] Inventors: Bernd Lindner; Nikola Pupic, both of Heusenstamm; Helmut Schild, Steinbach/Ts.; Berthold Seib, Rodgau, all of Germany

[73] Assignee: MAN Roland Druckmaschinen AG, Germany

[21] Appl. No.: 342,255

[22] Filed: Nov. 18, 1994

[30] Foreign Application Priority Data

Nov. 18, 1993 [DE] Germany ..... 43 39 344

[51] Int. Cl.[6] ..... B41F 27/06

[52] U.S. Cl. ..... 101/477; 101/216

[58] Field of Search ..... 101/216, 378, 101/415.1, 477, 485, 486, DIG. 36

[56] References Cited

U.S. PATENT DOCUMENTS

| | | | |
|---|---|---|---|
| 5,111,744 | 5/1992 | Wieland | 101/415.1 |
| 5,127,328 | 7/1992 | Wieland | 101/477 |
| 5,218,907 | 6/1993 | Komori et al. | 101/477 |
| 5,289,775 | 3/1994 | Spiegel et al. | 101/477 |
| 5,299,498 | 4/1994 | Spiegel et al. | 101/477 |
| 5,309,832 | 5/1994 | Merkel et al. | 101/415.1 |
| 5,309,835 | 5/1994 | Hartung et al. | 101/477 |
| 5,331,892 | 7/1994 | Seib et al. | 101/415.1 |
| 5,394,614 | 3/1995 | Lindner et al. | 101/415.1 |

FOREIGN PATENT DOCUMENTS

| | | | |
|---|---|---|---|
| 431715 | 6/1991 | European Pat. Off. | 101/415.1 |
| 0530577A1 | 7/1992 | European Pat. Off. . | |
| 503750 | 9/1992 | European Pat. Off. | 101/415.1 |
| 3940796C2 | 6/1991 | Germany . | |
| 4129022C2 | 6/1993 | Germany . | |
| 4214207C1 | 7/1993 | Germany . | |
| 4215969A1 | 12/1993 | Germany . | |
| 22755 | 2/1984 | Japan | 101/415.1 |
| 77401 | 3/1993 | Japan | 101/415.1 |
| 162288 | 6/1993 | Japan | 101/415.1 |

OTHER PUBLICATIONS

*Druckwelt* (Printing World). 4/25.021993, p. 24 ff.

*Primary Examiner*—Stephen Funk

*Attorney, Agent, or Firm*—Leydig, Voit & Mayer

[57] ABSTRACT

A magazine for the automated changing of printing plates of a sheet-fed offset printing machine. The magazine includes a guiding apparatus which can be put into place on the plate cylinder for purposes of conveying used printing plates out of the plate cylinder and for feeding new printing plates to the cylinder. The guiding apparatus may be formed by a sheet-metal profile. Provision is made of further guiding surfaces and a holder so that the used printing plate may be locked by the holder. An operator then only need pull the plate a short distance out of the gripping region of a leading edge clamping rail. Stops are provided for a printing plate so that the new printing plate can be deposited on the stops. By virtue of putting the guiding apparatus into place, the new printing plate is shifted toward the plate cylinder and can be fed into the front clamping rail by the operator.

8 Claims, 3 Drawing Sheets

APPARATUS FOR THE AUTOMATED CHANGING OF PRINTING PLATES OF A PRINTING MACHINE

BACKGROUND OF THE INVENTION

This invention relates to a magazine for the automated changing of printing plates of a printing machine, especially a sheet-fed offset printing machine.

In sheet-fed offset printing machines, a printing plate is fastened on the plate cylinder by means of a clamping rail allocated to the leading edge of the printing plate and a clamping rail allocated to the trailing edge. The clamping rails are arranged in a groove of the plate cylinder. For changing a printing plate, the clamp at the trailing edge is first released and the printing plate is conveyed away from the plate cylinder by means of rotating the latter in a backward direction until the clamp at the leading edge can also be released. A new printing plate is positioned with its front edge in the leading edge clamping rail, the front edge is clamped and thereupon the plate cylinder is rotated in the forward direction until the other end of the printing plate can be inserted into and clamped by the trailing edge clamping rail. Tensioning of the printing plate is carried out via the trailing edge clamping rail.

In conventional printing machines, the above-described steps are carried out by the printer and are time-consuming. For shortening the set-up time, provision recently has been made of so-called fully automatic printing plate changing systems in which the previously used printing plate is taken from the plate cylinder into a magazine while the new printing plate is taken from the magazine to the plate cylinder. EP 0 530 577 A1 discloses a magazine for automatic printing plate changing. The magazine is used in a normal position as a guard in front of the printing unit and can be driven vertically and also pivoted about a horizontal axis. For service purposes, the magazine can be pushed into an uppermost position. For changing the printing plate, the magazine is first pushed a short distance upwardly and is then pivoted toward the plate cylinder. As a result, a gap is produced both above and below the magazine. The gap must be protected with additional guarding means for purposes of operational safety. In addition, the magazine pivots with its upper end in the space between the printing units. Accordingly, it must be ensured by means of further complicated protective measures that nobody can enter the space between the printing units or that no risk of injury exists as a result. There also exists a risk of injury in pivoting the magazine to the vertical position since the edges of magazine and printing unit interact like the parts of a shear. The accumulated multiplicity of necessary protective measures is very disadvantageous.

DE 3 940 796 C2 discloses a printing plate changing magazine which remains in the same location as a guard in front of the printing unit cylinders in the normal position and in the printing plate change position. In order to bring the magazine into an upper position for working on the cylinders, the magazine is articulated on two parallel rockers in the manner of a couple. This articulation is necessary since parts of the magazine running in a curve toward the plate cylinder in the lower region are also located underneath the plate cylinder. When the magazine is driven upwardly, there also is a horizontal movement in the region between the printing units. Complicated protective measures are also necessary here in order to prevent the possibility of injury to persons.

A semi-automatic printing plate changing device is incorporated in the printing plate drawing-in system PPL (Power Plate Loading) of the firm MAN Roland Druckmaschinen AG and is at present in use on the R 700. In this apparatus, demonstrated in the German magazine Druckwelt (Printing World) 4/25.02.1993, page 24 ff and also described in German Patent Application P 42 15 969, the printer need only remove a printing plate conveyed out from the plate cylinder through a slot in the sliding guard and to feed a new printing plate through the same slot to the plate cylinder. For this purpose, the sliding guard is pneumatically movable in front of the printing unit cylinders. A guiding apparatus is provided and is supported so that it can be pivoted into place on and removed from the plate cylinder. The guiding apparatus is designed as a sheet-metal profile extending over the format width of the printing plate and includes a feed-in rail integrally molded at its end. In the case of this apparatus, the printer grips the old printing plate conveyed out from the cylinder and draws it out of the opened leading edge clamping rail. The guiding apparatus is thereupon moved into operative position adjacent the plate cylinder, and the printer guides a new printing plate via the guiding apparatus into the leading edge clamping rail. By means of the feed-in rail of the guiding apparatus, the printing plate front edge is automatically threaded into the gripping region of the leading edge clamping rail. However, an old printing plate cannot be stored and a new printing plate cannot be made ready with this apparatus.

DE 4 214 207 C1 discloses a nip roll which can be put into operative position on the plate cylinder. An edge-bending strip extends parallel to the nip roll and also can be put into operative position on the cylinder. The nip roll is used in a known way to stretch the new printing plate under tension on the plate cylinder circumference. The edge-bending strip is used for bending the following printing plate edge around the trailing edge contour of the plate cylinder. This apparatus serves for drawing up printing plates already fed into the gripping region of a leading edge clamping rail on the plate cylinder but not for the feeding of a new printing plate to the plate cylinder.

SUMMARY OF THE INVENTION

The general aim of the present invention is to provide a relatively simple and low cost magazine for automated changing of printing plates, the magazine avoiding the need of using complicated protective guards.

To achieve the foregoing, the magazine for picking up a new and a used printing plate is formed with slots in the upper part of the guard and, in addition, stops or holding means are provided by means of which the new or used printing plate is held against gravitational force. The printing plates are oriented vertically and penetrate by approximately one third or up to one half of their format length into the inside of the guard through the respective slots.

In the guard, and connected to the slots representing the magazine, a guiding apparatus for the feeding of a new printing plate is attached so as to be capable of being put into operative position on the plate cylinder. Associated with the guard and the slots is a further guiding surface for guiding away a used printing plate. With this arrangement, the movable parts which are used for changing the printing plate are arranged exclusively inside the guard and are moved in such a way that no additional protective devices are necessary. In addition, it is possible by means of the invention that the guard occupies the same vertical position both in the normal position and in the printing plate change position and, in particular, that no parts are pivoted into the space between neighboring printing units. An operator may, therefore, remain between the printing units and, in an advantageous embodiment of the invention, a used printing plate conveyed into the magazine thus may be conveyed by hand out of the leading edge rail and a new printing plate made ready can be fed by hand into the rail.

An operator may introduce the new printing plates into the slots provided therefor on all printing units and deposit them on stops. For example, this can occur during the running production of a previous print job. Then, when the printing plates are to be changed, the operator simply goes from printing unit to printing unit and triggers the printing plate change process for the respective printing unit by means of a command to be initiated via operating elements. The used printing plate is automatically guided out of the slot provided therefor in the guard by rotating the cylinder backward. Holding means in the form of a rubber lip seize the printing plate, and the operator then only need pull the printing plate out a short distance. A mark indicating the distance which the old printing plate need be pulled out can be provided on the printing unit.

After the used printing plate has been pulled a short distance out of the slot and is further held by the rubber lip in the slot, a controller automatically triggers the pivoting in of the guiding apparatus, whereupon the operator introduces the new printing plate into the open leading edge clamping rail. Register pins fixed adjacent the clamping rail can be interrogated electrically and cooperate with corresponding stampings on the front edge of the printing plate to enable it to be determined whether the printing plate is lying on correctly. If the controller establishes that this is the case, the gripping region of the leading edge clamping rail is closed to clamp the printing plate.

If the controller determines that the printing plate, after the clamping process, is still seated in-register, the controller transmits a signal to the main drive of the printing machine so that the latter rotates forward until the printing plate is fully drawn up. The trailing edge of the printing plate is introduced into the corresponding clamping rail, is clamped, and the tensioning is then carried out. Before the plate cylinder is set into rotation for drawing up the new printing plate, the controller transmits a corresponding signal to the actuating element of the guiding apparatus so that the guiding apparatus is pivoted back into its normal resting position.

According to a further preferred embodiment of the invention, the guiding apparatus is put into place on the plate cylinder and is removed again from the cylinder via a linear guide. In such a case, the stops on which the new printing plate are deposited constitute, at the same time, the elements of the linear guide. Also, the guiding apparatus is put into operative position only for feeding a new printing plate to the plate cylinder so that the new printing plate to be fed can come out of the effective range of the stops and then can be introduced into the opened gripping region of the leading edge clamping rail. Both during printing and during feeding out of a used printing plate, the guiding apparatus is removed from its operative position with respect to the plate cylinder. In the inactive position of the guiding apparatus, the magazine designed as a guard can be pushed vertically upward for service purposes. This embodiment of the invention also ensures that the magazine remains in the same vertical position both during printing and during printing plate changing.

In yet another very advantageous embodiment of the invention, the guiding apparatus may be fastened on a known edge-bending strip allocated to a nip roll which can be put into operative position on the plate cylinder. In this embodiment, it is essential that the guiding apparatus not pivot about a pivot axis fitted on the guard or on the magazine and thus not be capable of being driven vertically, and it also is essential that the guiding apparatus not be movable on corresponding guiding means fitted on the guard or on the magazine. In this embodiment, the guiding apparatus is pivoted about an axis fixed to the frame and is supported such that it can be put into place on and removed from the plate cylinder.

The special advantage of this type of mounting of the guiding apparatus in conjunction with the magazine is that no additional positioning means for pivoting the guiding apparatus need be provided. The putting into place of the guiding apparatus on the edge-bending strip having an associated nip roll is carried out by means of positioning means already provided for the edge-bending strip and the nip roll. In so doing, advantage is also taken of the fact that the new printing plate to be fed, deposited on the stops, can be picked up from the stops by means of the placing procedure and can thus be introduced into the opened gripping region of the leading edge clamping rail.

These and other objects and advantages of the invention will become more apparent from the following detailed description when taken in conjunction with the accompanying drawings.

Figure 1:
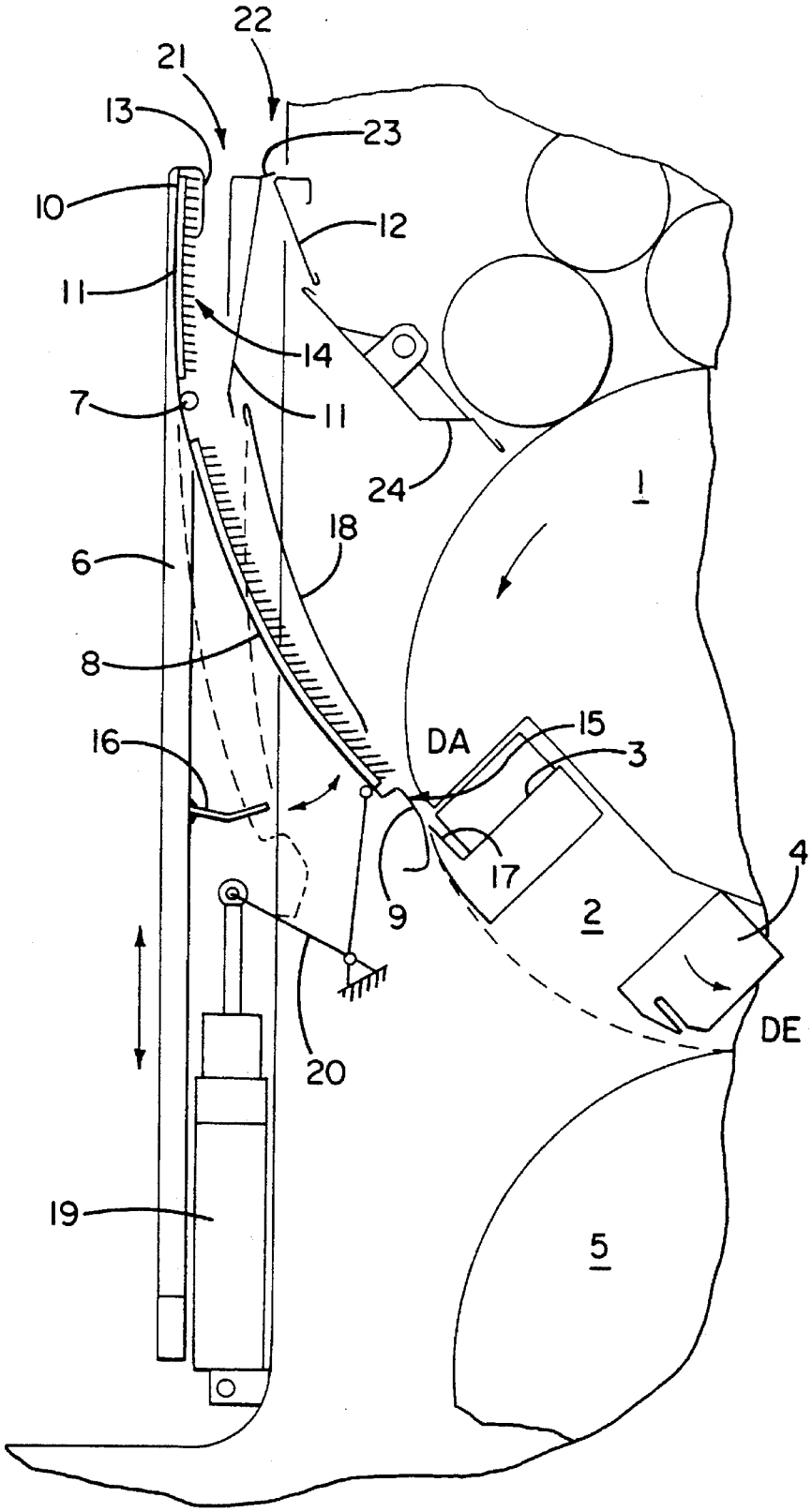
FIG. 1 is a fragmentary sectional view of one embodiment of a new and improved magazine incorporating the unique features of the present invention.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

FIG. 1 shows a section of a part of a printing unit of a printing machine of series construction. Between two side frame walls (not shown) of the printing unit is supported a plate cylinder 1 which has, in a cylinder groove 2, a clamping rail 3, 4 allocated to the leading edge DA and to the trailing edge DE of the printing plate. A rubber blanket cylinder 5 is located beneath the print cylinder.

In front of the printing unit, a guard 6 is arranged displaceably along a guide rail (not shown) attached to each side frame wall of the printing unit, the guard being shown in a normal position in FIG. 1 during the printing operation. The guard 6 can be shifted upwardly, as shown by the arrow, and extends over the width of the printing unit.

In the upper region of the guard 6, a pivot axis 7 is provided as a rotary joint, on which the guiding apparatus, designed as a sheet-metal profile 8, is suspended. The sheet-metal profile 8 in this case has a gentle curvature and has the format width of the plate cylinder 1. On the free end of the sheet-metal profile 8, a feed-in rail 9 is attached or is produced by means of approximately shaping the sheet-metal profile. The feed-in rail 9 may be pivoted to and from the outer circumference of the plate cylinder 1 in the direction of the arrows by pivoting the sheet-metal profile 8.

Fixed to the upper traverse 10 of the guard 6 are metal guide sheets 11 and 12 which have a length somewhat greater than the maximum printing plate format to be processed. On the concave inner side of the curved sheet-metal profile 8, brushes 14 are arranged in a plurality of strips spaced from each other. The bristles of the brushes support the printing side of a to-be-newly-fed printing plate.

The feed-in fail 9 on the free end of the sheet-metal profile 8 has the shape shown in FIG. 1 and has a feed-in surface 15, which lies approximately at the height of the upper side of the brushes 14, the feed-in surface pointing toward the plate cylinder 1. The feed-in surface 15 essentially forms a funnel-shaped path for the front edge of a new printing plate in the opened gripping region 17 of the clamping rail 3.

Arranged on the upper end of the guard 6, in addition to the metal guide sheets 11 and 12, is a further metal guide sheet 13 in the region of the brushes 14, so that the metal guide sheets 11, 12, 13 define two slots 21, 22. The slots 21, 22, like the metal guide sheets 11, 12 13, have a width which is somewhat larger than the maximum printing plate format to be processed. As explained further below, the slot 21 serves for picking up and feeding a new printing plate. The slot 22, in conjunction with the metal guide sheets 11, 12, is for guiding out a used printing plate.

In FIG. 1, the basic or normal position of the sheet-metal profile 8, that is to say, the normal position of the guiding apparatus, is shown with a dashed line. The guiding apparatus is in this position when printing is in process but this position is also assumed during guiding out of a used printing plate. For pivoting the sheet-metal profile 8 having the feed-in fail 9 in and out, pneumatic cylinders 19 are preferably attached to the side frame walls of the printing machine, the cylinders effecting the pivoting of the sheet-metal profile 8 via crank arms 20 fixed to the frame walls and driver pins (not shown) mounted thereon. The pneumatic cylinders 19 can also be fitted directly in the guard 6 or articulated directly on the sheet-metal profile 8.

To enable the sheet-metal profile 8 having the feed-in rail 9 to be supported securely on the plate cylinder 1 in the put-into-place position (FIG. 1), stops (not shown) made, for example, of polyamide, are carried on both ends of the feed-in rail 9. In this way, a secure and damage-free supporting of the guiding apparatus on the cylinder bearers of the plate cylinder 1 is possible. Supporting the guiding apparatus on the clamping rail 3 is also possible.

As shown in FIG. 1, a guiding surface 18, which also has a slightly curved form and can be pivoted together as a unit with the sheet-metal profile 8, is fitted in the region of the lower end of the metal guide sheet 11. A single-piece guiding surface 18 or a plurality of pivotably suspended tongues spaced from each other can be utilized. In FIG. 1, the normal position of the guiding surface 18 is shown with a dashed line. As will be explained, the used printing plate is conveyed out while the guiding surface 18 is in its normal position. The guiding surface 18 can likewise be produced from sheet metal or from synthetic material and is connected to the sheet-metal profile 8 via webs at each end of the profile.

Two stops 16 are spaced from each other and project through apertures (not shown) in the sheet-metal profile 8 in the normal position of the sheet-metal profile. The stops are fitted on the guard 6. In the normal position of the sheet-metal profile 8, a printing plate is deposited onto the stops 16 through the slot 21. The guiding surface 18 in this case occupies the position shown with a dashed line. After the printing plate has been released by the clamping rail 4 at the trailing edge DE and its end is thus free, the end of the printing plate is conveyed out of the slot 22 via the guiding surface 18 and the two metal guide sheets 11 and 12 by rotating the plate cylinder 1 backward.

On the upper end of the slot 22, there is positioned a rubber lip 23 extending over the width of the slot 22 and somewhat inclined upwardly, the rubber lip serving as a holding means. The plate cylinder 1 is rotated backward until it assumes the position shown in FIG. 1. The clamping rail 3 allocated to the leading edge DA is opened so that the used printing plate pushed into the slot 22 and through the flexible rubber lip 23 can be drawn out by hand from the gripping region 17 of the clamping rail 3. The rubber lip 23 in the arrangement shown acts as a holding means in a self-locking manner against the transport direction of the used printing plate. The rubber lip 23 is arranged above the slot 22 on its one edge and is flexed upwardly by the used printing plate. By virtue of the elasticity of the rubber lip 23, the printing plate driven into the slot 22 is pressed and held against the other edge of the slot. For example, the used printing plate may be pulled to a distance of 10 cm out of the gripping region so that its front edge presents no obstruction for the rotating plate cylinder 1 or other parts. To enable the end of the used printing plate to reliably find its way into the funnel-shaped region between the metal guide sheets 11 and 12 to the slot 22, an inlet guard 24 can additionally undertake a further guiding function.

A controller (not shown) interrogates register pins (not shown) mounted in a known way on the plate cylinder 1 in order to establish whether the used printing plate has been drawn out of the gripping region 17 of the opened clamping rail 3. If this is the case, the controller initiates the pivoting of the sheet-metal profile 8 via the pneumatic cylinders 19. By this means, the guiding surface 18 is also moved into the position shown in full in FIG. 1. In the normal position of the sheet-metal profile 8, the new made-up printing plate was deposited on the stops 16. The stops are dimensioned in their length in such a way that in the put-into-place position of the sheet-metal profile 8, the stops now no longer hinder the path of the printing plate to the plate cylinder 1. The printing plate is held only by friction between the brushes 14 and the guiding surface 18. By means of a light pressure of the operator on the trailing edge of the printing plate, the new printing plate can be pushed into the opened gripping region 17 of the leading edge DA clamping rail 3. By means of the controller, the plate cylinder 1 has previously been driven into the corresponding position. In turn, by means of the controller, an interrogation is now carried out as to the correct position of the printing plate on the register pins, whereupon the corresponding positioning means for closing the gripping region 17 are driven in order to clamp the printing plate at its leading edge. Thereafter follows another interrogation of the register pins in order to establish whether any displacement has taken place during clamping of the printing plate.

If the above interrogation is carried out with the correct result, the sheet-metal profile 8 is pivoted once again into its normal position by driving the pneumatic cylinders 19. Also, the plate cylinder 1 is rotated forwardly until the trailing edge of the printing plate is introduced into the clamping rail 4 allocated to the trailing edge DE, is clamped, and is tensioned. The printing plate change process is thus terminated and the actual printing process can begin. The used printing plate guided in the slot 22 and held by the rubber lip 23 can now be removed during the printing process, and a new printing plate for the next printing job can be fed into the slot 21 and deposited on the stops 16.

Figure 2:
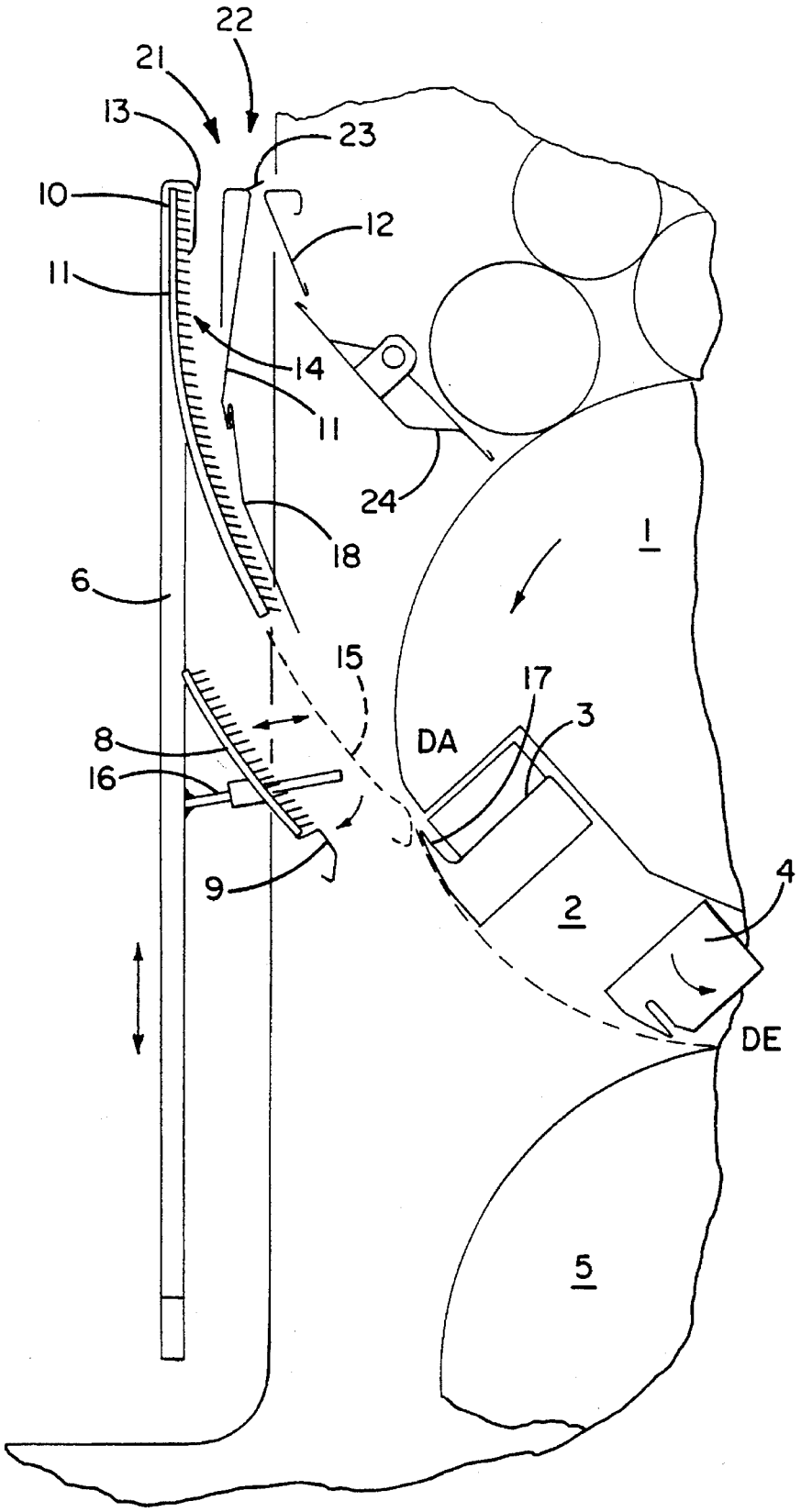
FIGS. 2 and 3 are views similar to FIG. 1 but show two alternate embodiments.

FIG. 2 shows a further and very advantageous embodiment of the invention. The metal guide sheet 11 having the brushes 14 is here extended downwardly in the form of a rigid, slightly bent contour into the guard 6 forming the magazine to such an extent that the ability of the guard 6 to move vertically is not hampered. Two stops 16 in the form of round bolts are fitted at a distance from each other, relative to the axis of the plate cylinder 1, in the guard 6 forming the magazine. As shown in FIG. 2, the stop bolts 16 have a predominantly horizontal orientation, directed slightly upward.

The guiding apparatus 8, 9 can be displaced linearly on the round stop bolts 16 via bearing means (not shown). The bearing means can, for example, be roller-bearing bushes. The stops 16 thus form a linear guide for the guiding apparatus 8, 9.

In FIG. 2, the guiding apparatus 8, 9 is shown in full in its normal position removed from the plate cylinder 1. In this position, the guard 6 forming the magazine can be pushed vertically upwardly, a used printing plate can be guided away from the plate cylinder 1 via the guiding apparatus 18, the printing plate may be conveyed into the slot 22 and, in addition, printing operations also may be carried out in this position of the guiding apparatus 8, 9. After a new printing plate to be fed has been deposited on the stops 16 through the slot 21 and past the metal guide sheet 11, the guiding apparatus 8, 9 can be put into place on the plate cylinder 1 following removal of a used printing plate. This is carried out by positioning means (not shown). The guiding apparatus 8, 9 is thus displaced from its basic position in a parallel fashion into the put-in-place position on the plate cylinder 1 as shown by the dashed line in FIG. 2. As shown in FIG. 2, the guiding apparatus 8, 9 has the same profiling and brushes 14 as the free end of the guiding apparatus 8, 9 shown in FIG. 1. Also, in this embodiment, the feed-in surface 15 forms, in the put-in-place condition, the funnel-shaped region for feeding a new printing plate into the opened gripping region 17 of the leading edge clamping rail 3.

The stops 16 forming the linear guide for the guiding apparatus 8, 9 are guided through corresponding apertures in the guiding apparatus 8, 9 and are dimensioned in such a way that no hindrance results with respect to the vertical displaceability of the guard 6 forming the magazine. Moreover, by virtue of putting the guiding apparatus 8, 9 into place on the plate cylinder 1, the front edge of the new printing plate is positioned such that the new printing plate can be introduced into the gripping region 17. Provision can also be made for pivoting disturbing parts (for example, the inlet guard 24) to enable vertical displacement of the guard 6.

Figure 3:
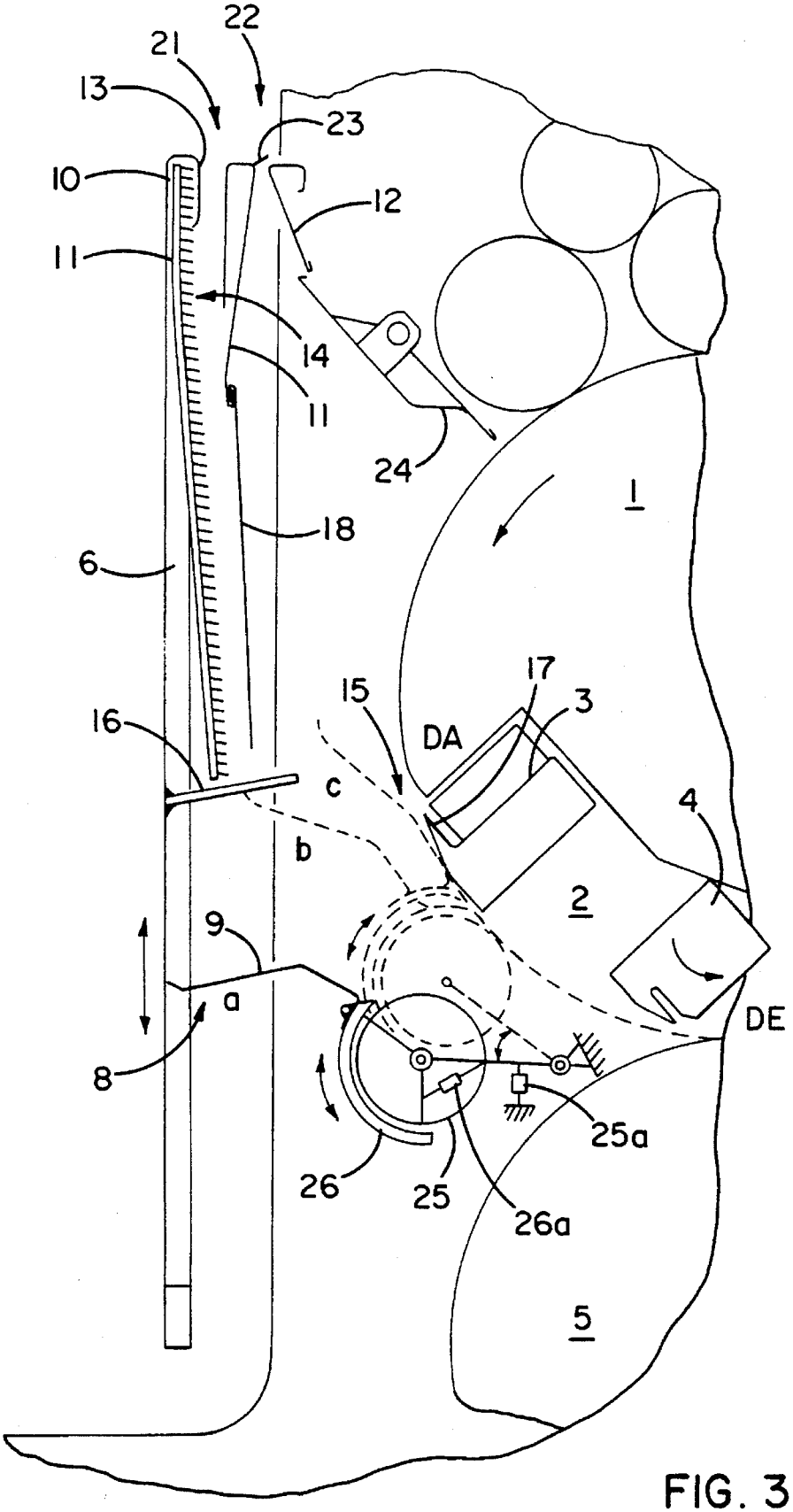

FIG. 3 shows a further preferred embodiment of the invention. In contrast to the attachment of the guiding apparatus 8, 9 to the vertically displaceable guard 6 forming the magazine according to FIGS. 1 and 2, the guiding apparatus 8, 9 of FIG. 3 is pivoted about an axle running parallel to the plate cylinder 1 and fixed with respect to the frame.

In a similar fashion to that in the embodiment according to FIG. 2, a metal guide sheet 11 having brushes 14 is extended downwardly in the form of a rigid metal guide sheet extending essentially linearly inside the guard 6 forming the magazine. The stops 16 are in the form of sheet-metal tabs which are fitted on the guard 6 near the end of the metal guide sheet 11 having the brushes 14. A new printing plate introduced into the slot 21 can be deposited on the stops 16.

FIG. 3 shows a nip roll 25 of a known type which can be put into place on the plate cylinder 1 and can be pivoted about an axis fixed to the frame via the supporting levers shown. The nip roll 25 is used for drawing up a new printing plate to be fed around the outer circumference of the plate cylinder 1 and, as a consequence, has the same format width as the plate cylinder. The supporting levers are fitted at both ends of the nip roll 25. Also, an edge-bending strip 26 with a shell-shaped profile is arranged in a manner known per se so as to be pivotable about the axis of rotation of the nip roll 25. The edge-bending strip serves in a known way for bending the following end of a printing plate around the contour of the trailing edge DE. For purposes of understanding, it should now be repeated only briefly here that a printing plate clamped in the gripping region 17 is drawn up around the plate cylinder 1 in the direction of the arrow by rotating the plate cylinder 1 and by means of putting the nip roll 25 into place on the plate cylinder 1. In so doing, the plate cylinder 1 is rotated until the clamping rail 4 allocated to the trailing edge DE comes approximately into the position where the front clamping rail 3 presently is shown in FIG. 3. During this process, the edge-bending strip 26 remains removed from the plate cylinder. For bending the edge of the printing plate around the contour of the trailing edge DE and for inserting its rear edge into the trailing edge clamping rail 4, the edge-bending strip 26 is then put into place on the plate cylinder 1 by means of a pivoting movement. The trailing edge clamping rail 4 grips the rear edge of the plate for clamping and for tensioning. The putting into place and removing of the nip roll 25 and the pivoting of the edge-bending strip 26 about the axis of rotation of the nip roll 25 are carried out by positioning means, 25*a* and 26*a*, and known per se, preferably in the form of pneumatic cylinders.

According to FIG. 3, the guiding apparatus 8,9 is designed as a format-width sheet-metal rail bent at two oblique angles. The guiding apparatus 8, 9 is fitted in this case on the part of the edge-bending strip 26 facing the plate cylinder 1. In FIG. 3, the normal position of the guiding apparatus 8, 9 and thus the normal position of nip roll 25 and edge-bending strip 26 is in solid lines and is indicated as a. During drawing up of the new printing plate around the outer circumference of the plate cylinder 1, the nip roll 25 is put into place on the cylinder, but the edge-bending strip 26 is removed from the cylinder. The guiding apparatus 8, 9 fitted on the edge-bending strip 26 thus assumes the position shown with a dashed line. In this case, the nip roll 25 put into place on the plate cylinder 1 is also shown with a dashed line. The length of the guiding apparatus 8, 9 fitted on the edge-bending strip 26 is of such a type that a new printing plate introduced through the slot 21 and deposited on the stops 16 is not hampered. After a new printing plate has been fastened on the clamping rail 4 at the trailing edge DE, the nip roll 25 and the edge-bending strip 26 are again removed from the plate cylinder and are located in the solid line position of FIG. 3. Then, the nip roll 25 is put into place on the plate cylinder 1 via the positioning means, there being stop means (not shown) preventing the nip roll 25 from falling into the cylinder groove 2. The guiding apparatus 8, 9 is thus pivoted from the position into the position. Then follows the putting into place of the edge-bending strip 26 and thus the pivoting of the guiding apparatus 8,9 into the printing plate feed position, that is to say, into the position. As shown, the guiding apparatus 8, 9 according to the invention is in this case shaped in such a way that one part of the sheet-metal profile nestles against the upper side of the front clamping rail 3. Thus, the central section of the guiding apparatus 8, 9, the so-called feed-in rail 9, forms with the side facing the plate cylinder 1 the feed-in surface 15 for the printing plate to be newly fed. By means of the pivoting of the guiding apparatus 8, 9, the printing plate previously deposited on the stops 16 is picked up from the latter with its pivotable end and can now be introduced by hand into the gripping region 17.

To enable pivoting of the guiding apparatus 8, 9 over the edge-bending strip 26 with simultaneous picking up of the new printing plate from the stops 16, the guiding apparatus 8, 9 has corresponding cut-outs in the region of the pivotable end so that the pivoting is not hampered by the stops. Also, allocated to the edge-bending strip 26 are stop means (not shown) which can be fitted on the guiding apparatus 8, 9 and effect a supporting on the upper side of the clamping rail 3 or on the cylinder bearers of the plate cylinder 1. In the embodiment according to FIG. 3, the guiding surfaces 18 are preferably designed as bendable plastic tongues spaced axially from each other and fitted on the metal guide sheet 11. Accordingly, a design of this type does not hamper the picking up of the new printing plate deposited on the stops 16 by pivoting the guiding apparatus 8, 9 forwardly from the position into the position. It should be mentioned that the guiding of a used printing plate out of the slot 22 is carried out via the guiding surfaces 18. Furthermore, it should be mentioned that the guiding apparatus 8, 9 is pivoted from the position a into the operating position in order not to hamper the vertical movability of the guard 6 forming the magazine.

The parts and sequences not mentioned in the embodiments according to FIGS. 2 and 3 are the same as explained with reference to FIG. 1.

We claim:

1. An apparatus for the automated changing of printing plates in a printing machine having a plate cylinder, the apparatus being used for feeding a new printing plate to and in picking up an old printing plate from the plate cylinder, the apparatus comprising, in combination:a guard that is vertically diplaceable and disposable in front of the printing machine, the guard including first and second slots located adjacent an upper end of the guard for feeding in and feeding out the new and used printing plates, respectively, means for storing a new printing plate in a standby position, a plate guiding apparatus and a means for moving the plate guiding apparatus between an inactive position spaced from the cylinder and an active position adjacent the cylinder, the plate guiding apparatus having means for guiding the new printing plate in the standby position substantially tangentially to the circumference of the cylinder when the plate guiding apparatus is in said active position, said storing means comprising stop means disposed on said guard, a new printing plate being fed in through said first slot resting on said stop means when said plate guiding apparatus is in said inactive position and being moved off of said stop means and toward said plate cylinder by said plate guiding apparatus as said plate guiding apparatus is moved toward said active position.

2. An apparatus according to claim 1 further including means adjacent an upper end of said second slot for releasably holding a used printing plate after the latter has been released from said plate cylinder.

3. An apparatus according to claim 2 in which said holding means comprise a rubber lip.

4. An apparatus according to claim 1 in which said plate guiding apparatus is a contoured sheet metal member supported to pivot between active and inactive positions about a generally horizontal axis.

5. An apparatus according to claim 4 in which said axis is defined by means carried by and displaceable vertically with said guard.

6. An apparatus according to claim 4 in which said sheet metal member includes a side facing said plate cylinder, there being a further guide member disposed in spaced opposing relation with said one side of said sheet metal member and pivotable about said axis as a unit with said sheet metal member.

7. An apparatus according to claim 1 further including a fixed frame, and means supporting said plate guiding apparatus on said frame and for providing pivotal movement of said plate guiding apparatus between said active and inactive positions about an axis fixed relative to said frame and extending parallel to an axis of said plate cylinder.

8. An apparatus according to claim 1 further including an edge-bending strip for bending and feeding a trailing edge of a new printing plate, a nip roll associated with said strip and means for moving said nip roll between active and inactive positions relative to said plate cylinder, means for moving said strip relative to said nip roll, and said plate guiding apparatus being fixed to said strip for movement of said plate guiding apparatus between its active and inactive positions as an incident to movement of said strip.

* * * * *